United States Patent [19]

Backlund

[11] 4,305,260

[45] Dec. 15, 1981

[54] COMPACT HEAT PUMP DEVICE

[76] Inventor: Anders D. Backlund, Holmen, S-820 90 Ytterhogdal, Sweden

[21] Appl. No.: 169,854

[22] Filed: Jul. 17, 1980

[30] Foreign Application Priority Data

Jul. 20, 1979 [SE] Sweden ..... 7906238

[51] Int. Cl.[3] ..... F25B 27/02; F25B 29/00; F25D 23/12

[52] U.S. Cl. ..... 62/238.6; 62/159; 62/260; 62/325

[58] Field of Search ..... 62/159, 325, 238.6, 62/260

[56] References Cited

U.S. PATENT DOCUMENTS 2,559,217 7/1951 Kehoe ..... 62/325 X
2,729,072 1/1956 Dybvig ..... 62/325
3,513,663 5/1970 Martin, Jr. et al. ..... 62/159

*Primary Examiner*—Lloyd L. King
*Attorney, Agent, or Firm*—Steele, Gould & Fried

[57] ABSTRACT

The invention relates to a compact heating assembly of the heat pump type, comprising a heat pump circuit having a compressor, an evaporator and a condenser, wherein the evaporator and condenser parts, together with means for heat exchanging heat carrying fluids against the same, are arranged in a housing. The evaporator and its heat exchanger means and the condenser and its heat exchanger means substantially form an essentially vertical helical conduit system which encloses an inner space, wherein the compressor, possible circulation pumps, etc. are arranged. The device can be burrowed in the ground, and the inner space is accessible via an inspection cover arranged at the top.

9 Claims, 2 Drawing Figures

COMPACT HEAT PUMP DEVICE

The present invention relates to a new compact heat pump device for the heating of e.g. buildings and intended to be located outside the building in question, preferably in the ground, in order not to occupy space in the building.

A conventional heat pump, i.e. a device wherein heat from a heat source of low temperature is "pumped" up to a higher temperature level by the addition of mechanical work, consists of a closed circuit wherein a readily evaporable liquid circulates as a heat carrier. The circulation circuit comprises an evaporator part, a compressor, a condenser part and a relief or expansion valve. Heat from the heat source, such as a lake or a ground portion, is added to the circulating medium by heat exchange against the evaporator part, the medium then being evaporated. The vapor is then fed into a compressor which compresses the vapor to raise the saturation temperature. The vapor is then condensed in the condenser portion wherein useful heat can be absorbed by heat exchange. Before the vapor is recycled to the evaporator part the condensate is allowed to pass through a relief valve so as to obtain a pressure suitable for the evaporation.

When using a heat pump for heating buildings the heat pump and the heat exchange devices are usually located in a special space inside the building. The heat pump assembly occupies valuable space in the building in question, and in addition thereto the compressor and the necessary circulation pumps give rise to a disturbing noise.

In accordance with the invention there is consequently proposed a compact heat pump/heat exchanger unit which is intended to be located outdoors and especially in the ground, whereby the above mentioned disadvantages are eliminated.

In the compact heat pump device according to the invention the compressor and necessary pump and fan devices are arranged inside a housing which comprises the evaporator and condensor parts and the corresponding heat exchangers. According to a preferred embodiment of the device admitted ventilating air and possibly also discharged ventilating air is heat exchanged against the heat pump unit.

Figure 1:
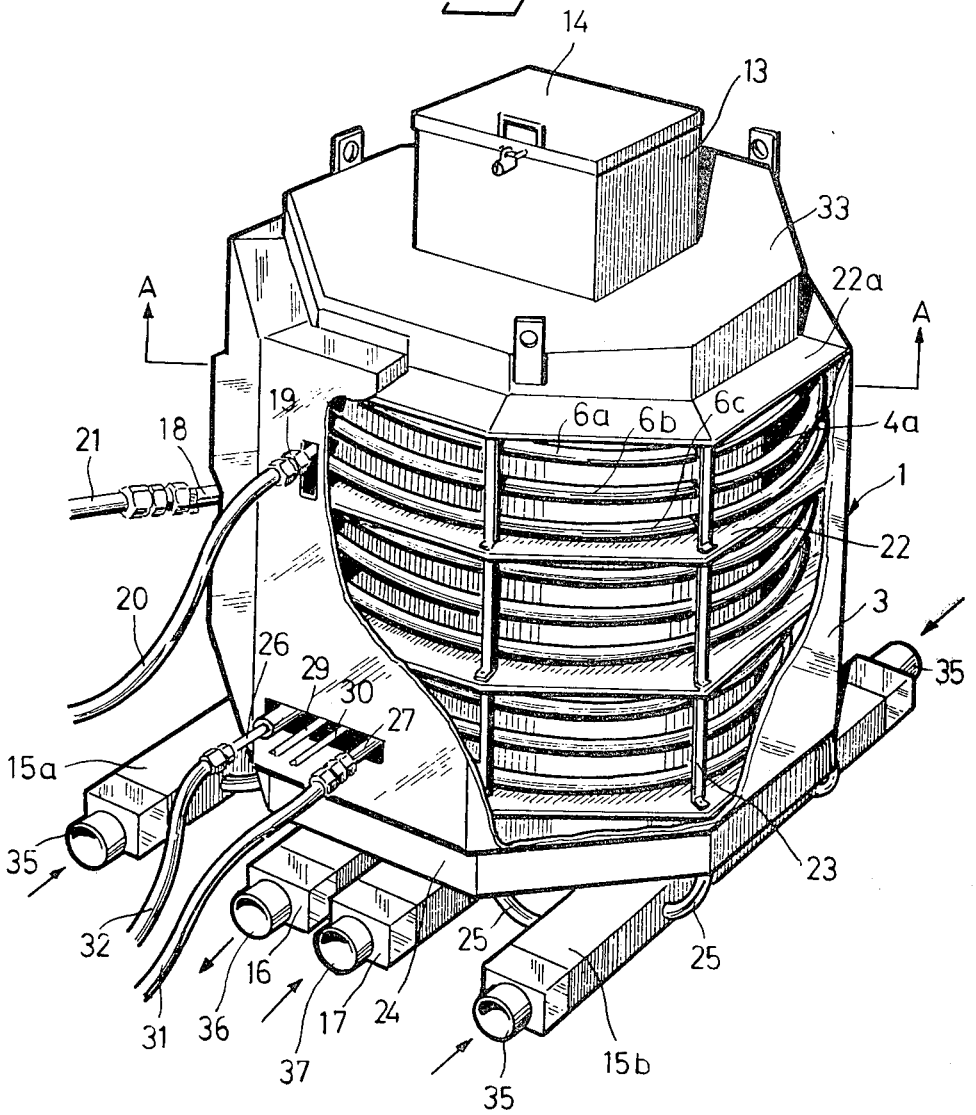
Figure 2:
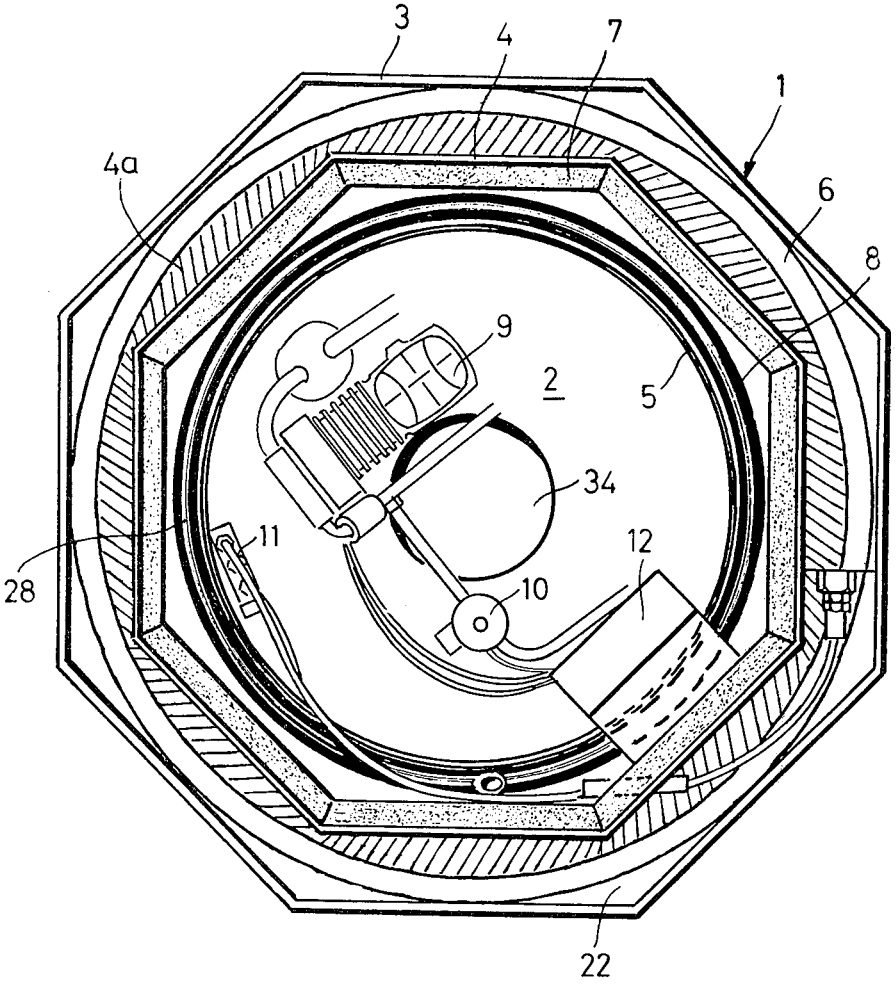

Further features of the invention appear from the subsequent claims and the following description of a special embodiment of the invention—to which it, however, in no way is restricted—reference being made to the enclosed drawings wherein FIG. 1 is a perspective view of one embodiment of a heat pump unit according to the invention, wherein for illustrative reasons certain parts are broken away, and FIG. 2 is a sectional view taken along A—A in FIG. 1.

The heat pump device shown in the Figures is designed as a container or vessel having—as best appears from FIG. 2—a wall or housing portion 1 with a space 2 inside thereof. The housing 1 comprises an outer wall 3, which in the illustrated case is octagonal, an intermediate wall 4—which also is octagonal in the illustrated case—and an inner wall 5. An evaporator unit with a corresponding heat exchanger system 6 is located between the outer wall 3 and the intermediate wall 4. An insulating layer 7 of any suitable material, e.g. "Frigolit", is provided on the other side of the intermediate wall 4. The inner wall is spaced apart from the insulating layer 7. A condenser unit with a corresponding heat exchanger system 8 is arranged in the space formed. Those devices which are located inside the space defined by the inner wall 5 of the vessel have only been schematically outlined in FIG. 2, such as a compressor 9, a circulation pump 10, expansion valves 11 and an electricity box 12. This inner space is accessible from the outside through an inspection portion 13 at the top of the exterior of the container, provided with a cover 14 which can be opened. At the bottom portion of the vessel there are provided two inlet manifolds 15*a*, 15*b* and an outlet manifold 16 for air which has been heated, as well as an inlet manifold 17 for discharged ventilating air. The evaporator/heat exchanger unit 6 comprises an inner tube (not shown) of e.g. copper, which is arranged concentrically inside a tube or a hose system, which is arranged helically in the space between the outer and intermediate walls 3 and 4 respectively. The hose system can by means of inlet and outlet connections 18 and 19 respectively, via hoses 20 and 21, be connected to a heat exchanger system disposed in a source of low temperature heat. The latter suitably consists of a ground portion, in which case the heat exchanger system may consist of a tube or hose system arranged in the ground. In this hose system, and consequently also through the heat exchanger portion 6 of the evaporator, a suitable heat carrying medium such as a methanol/water mixture is circulated by means of a pumping device, for example the above mentioned circulation pump 10. In the illustrated case the evaporator/heat exchanger 6 is, for capacity reasons, provided with three parallel hose systems 6*a*, 6*b*, 6*c* which extend helically along the outside of the intermediate wall 4 of the vessel. A transverse wall 22 which extends helically in the space between the outer wall 3 and the intermediate wall 4 defines a helical channel for the hoses 6*a*, 6*b*, 6*c* in said space. The helical transverse wall 22 is supported by vertical brackets 23. An insulation layer 4*a* is preferably provided between the heat exchanger tube 6 and the outer side of the intermediate wall 4. Of course, more or fewer than three parallel hoses 6*a–c* can be used, e.g. one, two or four hoses. For reasons to be indicated below the parallel hoses 6*a–c* are further spaced apart from each other. In the bottom portion 24 of the vessel the above mentioned channel for the evaporator/heat exchanger unit 6 preferably extends helically inwardly (not shown) with the three parallel hoses 6*a*, 6*b*, 6*c* still being arranged above each other. The evaporator tubes of the primary circulation system of the heat pump, which are arranged inside the hoses 6, are at the inlet side (in the vicinity of the hose connection 19) connected to the expansion valves 11, and they are at the outlet side (at the bottom portion 24) connected to the suction side of the compressor 9.

The inlet manifold 17 for discharged ventilating air to be heat exchanged against the evaporator unit 6 is by means of an opening provided in the bottom portion of the vessel connected to the above mentioned helical channel at the bottom portion 24 of the vessel. This helical channel forms, together with the channel formed by the transverse wall 2, a continuous air duct from the bottom of the vessel to the top portion thereof, outlet openings (not shown) for the air being provided in the top portion 22*a* of the transverse wall 22. Because the hoses 6*a–c* are spaced apart from each other, there channels are also formed between the parallel hoses 6*a–c*.

The condenser unit 8 at the inside of the intermediate wall 4 is in the same manner as the evaporator unit 6 provided with an inner condenser tube, forming part of the primary circulation circuit of the heat pump, and an outer tube or hose system having inlet and outlet connections 26 and 27 respectively. The condenser system 8 is like the evaporator system 6—in the illustrated case, however, using one single hose—arranged helically in the space formed between the insulation 7 and the inner wall 5. The inlet part of the condenser is located at the top of the vessel and is thus in conventional manner connected to the pressure side of the compressor 9. Because of the relatively high temperature which can be obtained in the condenser tube, the top portion of the heat exchanger tube preferably consists of a copper tube 28, which can be connected to inlet and outlet connections 29 and 30 respectively for hot tap water. The rest of the heat exchanger tube 8 of the condenser can, for example, consist of plastic hose. By means of the above mentioned connections 26 and 27 the condenser can be connected to, for example, the radiator system in a building by means of hoses 31 and 32, hot water being circulated through said heating system and condenser system of the vessel by means of a circulation pump (not shown) located in the internal space 2. In certain cases it can be desired to circulate a freezing point depressed water mixture, the hot tap water system then being arranged as a separate part of the condenser unit 8.

As in the evaporator system 6 the tubing or hose system of the condenser unit 8 is arranged with space between the helical turns so as to form a channel between the hose turns in the space between the insulation 7 and the inner wall 5.

The two inlet manifolds 15*a* and 15*b* for air to be heated are by means of a number of hose connections 25 (in the illustrated case one at each of the eight corners of the vessel) connected to the lowermost of the channel spaces formed by the condenser/heat exchanger unit 8. Since the latter, like the inner wall 5, does not extend all the way up to the top portion 33 of the vessel, the space formed between the intermediate wall 4 with the corresponding insulation 7 and the inner wall 5 will communicate with the internal space 2. The latter communicates with the outlet manifold 16 for the heated air by means of a central opening 34.

The above described device can, for example, be used in the following manner:

The device shown in the Figures is burrowed in the ground outside the building to be heated, and at least part of the inspection portion 13 should be above the ground level so as to make the inspection door 14 readily accessible. The necessary conduits for refrigerant, water and air are connected in connection with the burrowing. Thus, the inlet and outlet connections 18 and 19 respectively of the evaporator unit 6 are connected to any suitable low temperature heat energy source, for example a hose system located in the ground and represented by the hoses 20 and 21. Further, the heat exchanger system of the condenser unit 8 is by means of the connections 26 and 27 connected to the radiator system of the building to be heated. The hot tap water conduit system of the building is connected to the connections 29 and 30. Suitable inlet conduits for air to be heated are connected to the respective connections 35 of the inlet manifolds 15*a* and 15*b*. In corresponding manner conduits for heated air and discharged air from the building respectively are connected to the connections 36 and 37 of the manifolds 16 and 17 respectively. Finally, the necessary electric connections are made to the above mentioned electricity box 12. With regard to the above mentioned outlet openings provided in the uppermost portion 22*a* of the transverse wall 22 the covering of the top portion of the vessel should preferably be made using coarse gravel or the like.

In operation the above described device functions as follows:

A suitable heat carrying fluid, e.g. a methanol/water mixture, is circulated in the hose system provided in the ground and through the heat exchanger hoses 6 of the evaporator unit. The circulation is obtained by means of a circulation pump provided in the inner space of the vessel, such as the above mentioned pump 10, and this is done in a manner such that the fluid enters via the connection 18 and is distributed to the three hoses 6*a–c*, and leaves the vessel via the connection 19 after having flown through the helical hose system from the bottom portion 24 of the vessel and upwardly. In corresponding manner the radiator water to and from the building is circulated through the heat exchanger tube/hose of the condenser unit 8 by means of a pump (not shown) located in the interior 2 of the vessel. Also in this case the circulation is preferably performed such that the water to be heated enters the lower part of the condenser/heat exchanger unit 8 and is discharged at the top portion thereof. In the case where, as indicated above, a separate circuit is provided for hot tap water a further circulation pump is provided for this circuit.

The fluid, e.g. a Freon, in the primary conduit system of the heat pump, i.e. the one comprising the evaporator and condenser tube systems which are located in the corresponding heat exchanger tubes/hoses 6 and 8, is circulated in conventional manner through the compressor 9. In doing so the fluid absorbs heat from the heat carrying medium circulating in the evaporator heat exchanger circuit 6, which in turn has been heated when passing the tubing or hose system provided in the ground. After compression in the compressor 9 the heated heat pump fluid is passed to the condenser unit 8, where it condenses, and the hot tap water/radiator water circulating in the heat exchanger tube/hose is heated.

Air to be heated is drawn into the inlet manifolds 15*a*, 15*b* and is by means of the tube or hose connections 25 passed to the space between the intermediate wall 4, with the corresponding insulation layer 7, and the inner wall 5, wherein the condenser/heat exchanger unit 8 is arranged. The air then passes upwardly in the channel formed between the condenser heat exchanger loops 8. The cold air thus enters the coldest part of the heat exchanger hose to leave said channel after the uppermost, and consequently warmest, loop. The air is then drawn, by means of a fan (not shown) provided in the inner space 2, down through the opening 34 and via the outlet manifold 17 and is passed into the building to be heated by means of the conduits connected thereto.

The discharged air from the building is heat exchanged against the heat exchanger hoses of the evaporator unit for heat recovery. This is done by leading the discharged air from the building into the inlet manifold 17 by means of the connections 37. From there the air is blown, by means of a suitably arranged fan, into the lower part of the helical channel formed between the outer wall 3 and the inner wall 4 of the transverse wall 22. The discharged air will then pass helically upwardly along the walls between the hose 6*a–c* and be heat exchanged against the same. The air thus enters the warmest portion of the evaporator heat exchanger hoses and is deprived of heat during its passage in the channel system to leave the same by means of the openings (not shown) provided in the uppermost transverse wall loop 22*a*.

In order to further improve the degree of heat utilization the fresh air to be heated can be preheated partly against the ground and partly against the discharged air leaving the building. This can be done by letting the fresh air, before it is fed into the inlet manifolds 15*a*, 15*b*, pass a hose portion arranged in the ground layer and then through a hose or a tube concentrically located inside the discharged air conduit extending from the building in question to the inlet manifold 17. By making the outer tube or the outer hose at least partly perforated water steam can be condensed directly in the ground.

The above described device has several advantages. Thus, a compact heating unit is obtained, which is simple to install and which does not give rise to noise from compressors, pumps and fans in the building to be heated. In spite of the fact that it is burrowed in the ground it is, thanks to the inspection cover 14, readily accessible for control, service and repair. By passing the fresh air through the device heat from the compressor, pumps, etc. is also collected. Further, the size is flexible, and it is also possible to connect several such heat pump devices in parallel, when necessary. For bigger heat consumers, such as apartment houses, etc., several such heat pump devices can be required during winter time, whereas during the warm season one single device can be sufficient for heating hot tap water.

During the warm season, when the heat demand is lower, the compressor will not be used for longer periods. By having the pump for the relatively cold fluid circulating through the evaporator heat exchanger conduits 6*a–c* work continuously, the interior of the housing will be cooled in the absence of condensor heat, and thus the fresh air passing therethrough will be cooled. Cool air can also be obtained by changing the flow direction of the fan passing discharged air from the building past the evaporator heat exchange conduits 6*a–c*. In the latter case fresh air will thus be taken in at the top of the housing, pass through the channels between the heat exchange hoses 6*a–c* and be discharged to the building through the manifold 17. The above described methods can be used separately or in combination. It is also possible to have the fresh air supplied permanently in the combined way, e.g. for such cases when the discharged air from the building is not suitable to pass through the heating device of the invention, e.g. when it is used for heating cowhouses and the like.

The heating device or devices according to the invention can be used as a single heat source for heating a building etc., or as a supplemental heating source. In certain cases, e.g. in an old house having comparatively small radiator surfaces, the heat pump device can be used for increasing the proportion of air-carried heat. In this case the condenser heat exchanger tube (i.e. the outer tube) is made of copper in order to provide improved heat transfer between the circulating hot water and the fresh air flowing along the tube. Alternatively, the hot water can be passed through a liquid/air cooler (a so-called aerotemper) provided outside the vessel. The above mentioned copper loops may optionally be provided with cooling flanges. In those cases where it is not necessary to use the device for heating water the entire condenser part can be used for heating air, the outer heat exchanger tubes or hoses thus being replaced by suitable air channels. As an alternative only a small portion of the condenser part can be used for heat exchange against hot water.

In the described embodiment the condenser part has been designed having a single heat exchanger hose of helical shape. It is, of course, also in this context, as for the evaporator part, possible to use two (or possibly more) hoses connected in parallel, it also being possible to utilize a more delimited channel system by using a helical transverse wall. However, it is, of course, not necessary to utilize the indicated channel systems either in the evaporator or in the condenser part.

The invention is, of course, not restricted to the above specifically described and shown embodiment, but many variations and modifications are possible within the scope of the subsequent claims.

What I claim is:

1. A compact heat pump unit for heating systems, which is intended to be placed outside a space to be heated, comprising a heat pump circuit, including compressor means, evaporator and condenser parts and a heat carrying medium to be circulated in said circuit, first heat exchange means for heat-exchanging a first heat-carrying fluid against said evaporator part, second heat exchange means for heat exchanging at least one second heat-carrying fluid against said condenser part, and a housing enclosing said heat pump circuit and said first and second heat-exchange means, and having access means at the top thereof, said evaporator part together with said first heat exchange means forming a first, substantially vertical helical conduit system, and said condenser part together with said second heat exchange means forming a second, substantially vertical helical conduit system, said first and second helical conduit systems being arranged peripherally in the housing so as to define an inner, central space for receiving said compressor means, said space being accessible through said access means.

2. The compact heat pump unit according to claim 1, wherein each of said first and second helical conduit systems comprises an inner conduit and an outer conduit enclosing the inner conduit, the outer conduits forming said first and second heat exchange means respectively, and the inner conduits forming said evaporator and condenser parts respectively.

3. The compact heat pump unit according to claim 1, wherein said first and second helical conduit systems are arranged essentially concentrically in said housing, with said second helical conduit system arranged inside of said first helical conduit system.

4. The compact heat pump unit according to claim 1, further comprising a channel system for heat exchanging fresh ventilating air against said second heat exchange means.

5. The heat pump unit according to claim 1, further comprising a channel system for heat exchanging ventilating air against said first heat exchange means.

6. The compact heat pump unit according to claim 5, wherein said housing comprises an outer wall, an inner wall and a transverse partition wall extending helically therebetween in the vertical direction and defining a helical duct between said outer and inner walls, said first helical conduit system being arranged in said duct.

7. The compact heat pump unit according to claim 1, wherein said first helical conduit system comprises at least two conduits connected in parallel.

8. The compact heat pump unit according to claim 1, wherein said first and second helical conduit systems are separated from each other by a heat insulating material.

9. The compact heat pump unit according to claim 1, which is arranged to be burrowed in the ground.

* * * * *

UNITED STATES PATENT AND TRADEMARK OFFICE

CERTIFICATE OF CORRECTION

PATENT NO. : 4,305,260

DATED : December 15, 1981

INVENTOR(S) : Anders D. Backlund

It is certified that error appears in the above-identified patent and that said Letters Patent are hereby corrected as shown below:

At Column 2, line 62, delete reference numeral "2" and insert -- 22 --.

At Column 6, line 1, delete "exchanger" and insert -- exchange --.

Signed and Sealed this

*Seventeenth* Day of *August 1982*

[SEAL]

*Attest:*

GERALD J. MOSSINGHOFF

*Attesting Officer*

*Commissioner of Patents and Trademarks*